US005990848A

United States Patent [19]

Annamaa et al.

[11] Patent Number: 5,990,848

[45] **Date of Patent: *Nov. 23, 1999**

[54] COMBINED STRUCTURE OF A HELICAL ANTENNA AND A DIELECTRIC PLATE

[75] Inventors: Petteri Annamaa, Oulu; Seppo Ojantakanen, Paavola; Seppo Raatikainen, Kempele; Tero Haapamäki; Pekka Kinnunen, both of Oulu; Kai Vuokko, Tampere; Tero Kuittinen, Oulu, all of Finland

[73] Assignee: LK-Products OY, Kempele, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/801,884

[22] Filed: Feb. 18, 1997

[30] Foreign Application Priority Data

Feb. 16, 1996 [FI] Finland ..... 9607011

[51] Int. Cl.[6] ..... H01Q 1/36

[52] U.S. Cl. ..... 343/895; 343/725; 343/790

[58] Field of Search ..... 343/895, 878, 343/790, 791, 900, 702, 725, 728, 729

[56] References Cited

U.S. PATENT DOCUMENTS

| | | | |
|---|---|---|---|
| 4,229,743 | 10/1980 | Vo et al. | 343/895 |
| 4,772,895 | 9/1988 | Garay et al. | 343/895 |
| 4,935,747 | 6/1990 | Yuichi et al. . | |
| 5,021,799 | 6/1991 | Kobus et al. . | |
| 5,329,287 | 7/1994 | Strickland | 343/895 |
| 5,349,365 | 9/1994 | Ow et al. | 343/895 |
| 5,406,693 | 4/1995 | Egashhira et al. | 343/895 |
| 5,412,392 | 5/1995 | Tsunekawa | 343/895 |
| 5,489,916 | 2/1996 | Watermann et al. . | |
| 5,594,457 | 1/1997 | Wingo | 343/895 |
| 5,600,341 | 2/1997 | Thill et al. | 343/895 |
| 5,754,146 | 5/1998 | Knowles et al. | 343/895 |

FOREIGN PATENT DOCUMENTS

| | | | |
|---|---|---|---|
| 0 590 534 A1 | 9/1993 | European Pat. Off. | H01Q 1/24 |
| 0 649 181 A1 | 10/1994 | European Pat. Off. | H01Q 1/36 |
| 0 747 990 A1 | 12/1996 | European Pat. Off. | H01Q 1/24 |
| 78198 | 6/1989 | Finland | H01P 7/04 |
| 2 702 091 | 9/1994 | France | H01Q 9/30 |
| 2 280 789 | 2/1995 | United Kingdom | H01Q 1/38 |

*Primary Examiner*—Michael Tokar
*Assistant Examiner*—Daniel D. Chang
*Attorney, Agent, or Firm*—Darby & Darby

[57] ABSTRACT

The invention relates to a particular structure of high-frequency antenna, which comprises a support element (1) provided with a cylindrical coil conductor which forms a helix (2). On the support element (1) there is formed, for example by means of a conductive coating, the electrical parts of the antenna, such as the attachment points **(3*b*) for the helix and for other parts, such as feeder lines (4), radiators (5) or impedance matching devices. By varying the number and size of the helices (2), the number and form of the feeder lines (4) and radiators (5)** and the quality of any impedance matching devices, it is possible without difficulty to obtain a very wide choice of different antenna structures. The feeder lines and radiators extend, at least in part, within the helix.

11 Claims, 14 Drawing Sheets

COMBINED STRUCTURE OF A HELICAL ANTENNA AND A DIELECTRIC PLATE

The present invention relates to a particular high-frequency antenna structure, and more precisely to a helical antenna structure provided with support elements.

BACKGROUND OF THE INVENTION

The helix is a cylindrical coil conductor, such as employed in high-frequency electronics in, among other things, resonator and antenna structures, in particular in portable radio appliances, such as mobile telephones.

Antennae in which use is made of a helical antenna supported on a support plate inside the helix have been proposed in GB Patent Application No 2 280 789. The publication in question contains a proposal for a structure where strip areas which consist of a conducting material and which constitute a helix antenna are formed on the surface of a dielectric substrate. The conducting areas are, for example, created on one side only of the substrate, which substrate is bent into the form of a cylinder, thus producing a helical antenna. Another method is to produce, on both sides of the substrate, conductor strips which are joined to conductor strips on the opposite side, so that a helical antenna element is obtained. The publication also contains a proposal for the connection of a whip antenna to a helix antenna with a separate connecting means through which the whip component may move. U.S. Pat. No. 4,935,747 proposes a helix antenna where the helix is placed around a support member which in cross section has the shape of a cross. The helix and support member are against a reflector on which a strip line is formed for antenna feed.

In both of the cases described above, the support member inside the helix is intended to retain and support the helical form, only the helical component being a radiator. The problem with such a solution is that other possible components of the antenna, such as the transmission line or the whip antenna, have to be connected to the helix by other means and have to be attached to the support structure of the antenna by other means.

An antenna formed from conductor patterns on the surface of a dielectric substrate has been described in U.S. Pat. No. 5,021,799. This patent proposes a dipole antenna, which is formed with the aid of conductor strips which are created on the surface of the substrate. The antenna in the patent in question has no helical component whatsoever. The problem with this type of solution lies in its large size. By using a helix it is possible to restrict the physical dimensions of an antenna designed for a particular wavelength range.

The combination of a dielectric plate and a helix is also employed in the helix-comb filter produced by LK Products Oy, which is described in Finnish Patent No. 78198. The patent also proposes a resonator structure, in which there is a cylindrical coil conductor forming the helix-resonator, which conductor is supported on a plate situated inside it and made from an insulating material. On the insulation plate, strip lines are used to form an electrical circuit to which the helix resonator is connected. This patent does not, however, concern use of the structure as an antenna, since in the design of resonator structures it is desirable to eliminate radiation to the environment.

EP application No. 590 534 describes the use of a helix in combination with a dipole antenna pattern formed on a dielectric plate. The application describes an antenna which can be retracted into a housing, whereby conductive patterns on the dielectric plate form both a sliding contact and an antenna pattern. The application does not, however, present a structure which could easily be used in mass production for producing many different types of antennas.

SUMMARY OF THE INVENTION

The objective of the invention presented in this application is to propose a small and versatile helix antenna structure. The objective of the invention is also to propose an antenna structure with characteristics which may be closely adhered to in series production. This objective is attained by forming other parts of the antenna (such as transmission lines, radiators and matching elements) on the support plate which supports the helix, for example with the aid of conductive patterning formed on the surface thereof To be more precise, the characteristic of the solution according to this invention is that there is located on the dielectric plate an electrically conductive conductor pattern, which pattern is in electrical contact with the helix and which extends at least in part inside the helix.

The invention proposed in this application is based upon a combination of a dielectric plate and a helix such that the plate supports the helix. On the plate are attachment points for attaching the helix thereto. Also formed on the plate are conductor patterns, with the aid of which at least one of the following functions is realized: antenna feed, matching elements, or a radiator formed on the dielectric plate. With this antenna structure it is possible to provide balanced, unbalanced and coaxial feeds.

With a structure according to the invention it is possible to obtain very versatile antenna structures with a high degree of dimensional accuracy and reproducability compared with known antenna solutions. The structure makes it possible to produce, for example, a simple, normal helix antenna, a shortened whip antenna with a helix and/or end capacitance and a helix-dipole antenna. This structure is also suitable for the production of dual-band antennae, where the antenna is in tune at two different frequencies. In that case the operation of two frequencies is achieved either by two overlapping or nesting helices, or by means of a pattern on the dielectric plate which acts as an antenna and/or a transmission line feeding the antenna.

On the dielectric plate it is also possible to have, in addition to a radiator and transmission line, attachment points for the helix, impedance matching devices and balanced and coaxial feeds for the antennae. The antenna structure may be attached directly to the circuit board of a radio appliance, or it may form part thereof. In addition, with a view to providing external, interchangeable antennae, an antenna according to the invention may also be attached to a separate connector, and may be protected with an elastic material.

BRIEF DESCRIPTION OF THE DRAWINGS

The invention will be described in greater detail below with reference to favorable embodiments introduced by way of example and with reference to the attached drawings, where.

In the drawings, the same reference numbers and symbols are used for corresponding parts.

DESCRIPTION OF EXEMPLARY EMBODIMENTS OF THE INVENTION

Figure 1:
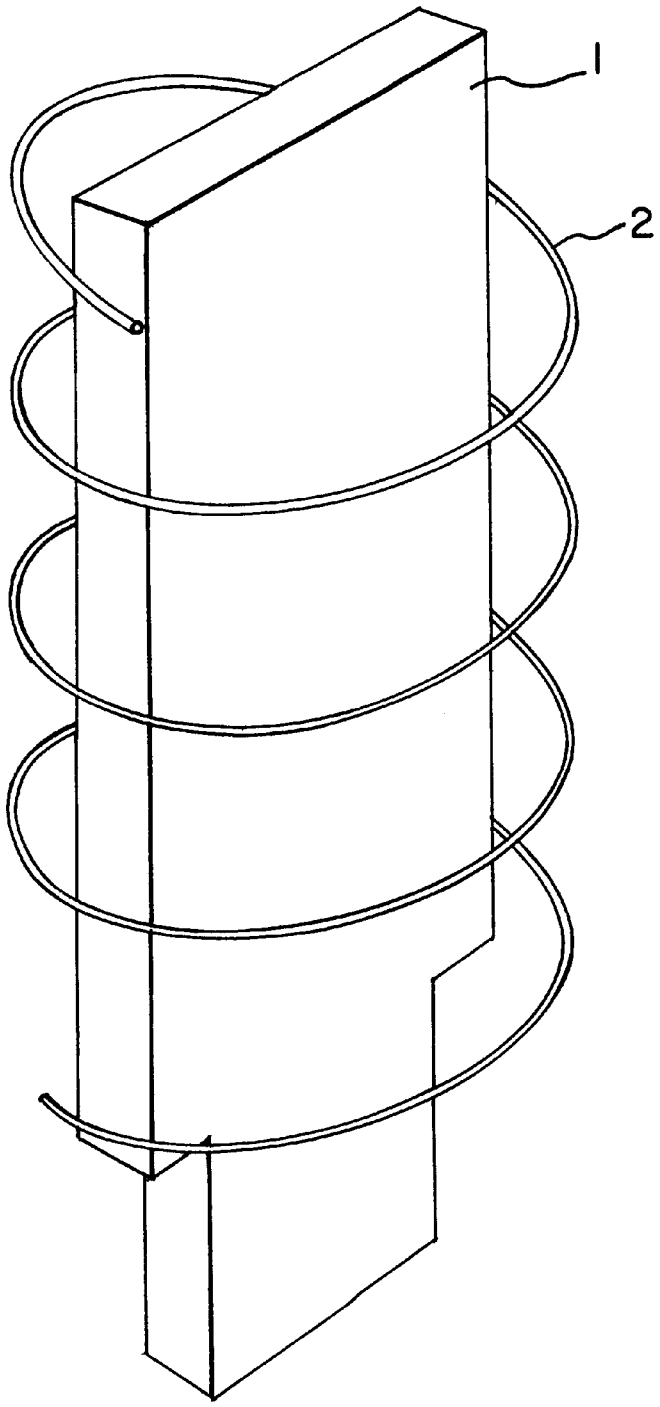
FIG. 1 is an isometric view illustrating the principle of the antenna structure.

FIG. 1 is an isometric view illustrating the principle of the antenna structure according to the present invention, modifications of which are shown from the side in other drawings. FIG. 1 shows the dielectric plate 1 which forms part of the antenna and a helix 2 wound around it. The dielectric plate may, for example, be a circuit board on which a conductor pattern is formed.

Figure 2A:
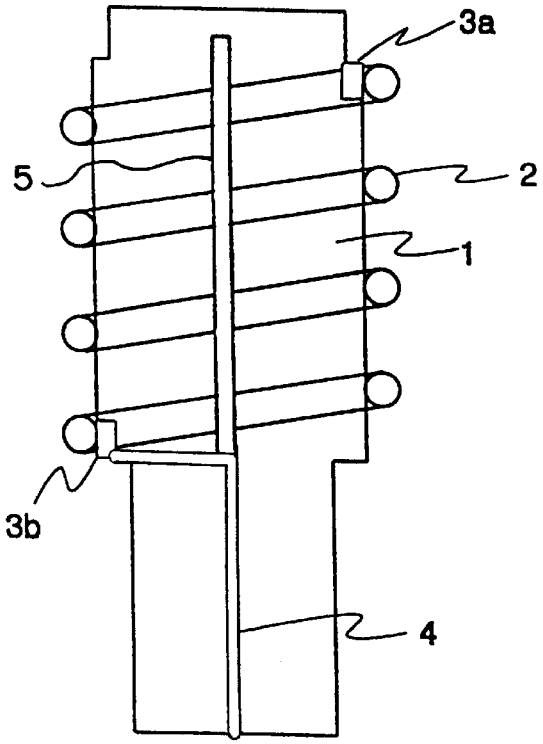
FIGS. 2(*a*)–2(*c*) are illustrations of same principles as seen from three different directions.
Figure 2B:
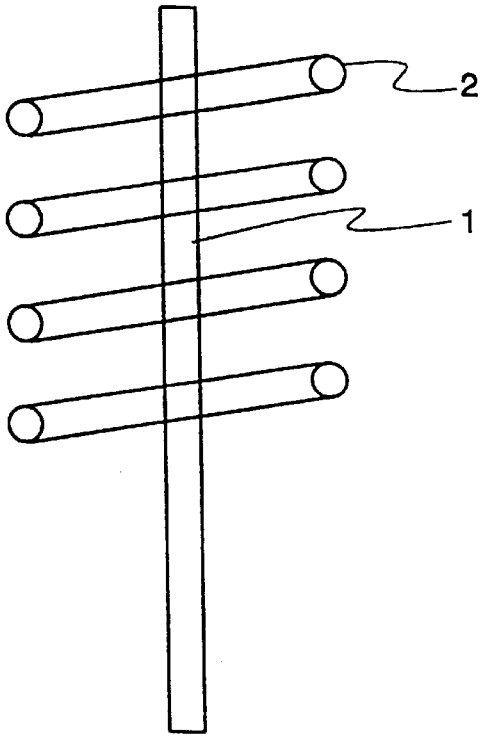
Figure 2C:
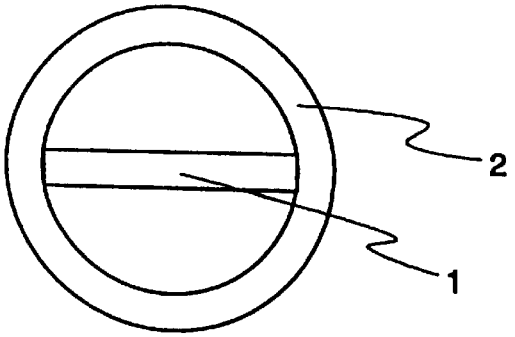

FIG. 2 shows the structure in question viewed from two different sides (FIGS. 2(*a*) and (*b*)) and from below/above FIG. 2(*c*)). From the figures the important basic components of the structure can be seen: the dielectric plate 1, which extends through the helix and supports it, and the patterns 3*a*, 3*b*, 4 and 5 on the dielectric plate. The functions of the dielectric plate 1 and of the patterns thereon are varied, depending as they do upon the type of antenna to be produced with the structure. For example, in FIG. 2(*a*) attachment points 3*a* and 3*b* for attachment of the helix are marked, and with these the helix may be locked, for example by pasting, onto the dielectric plate 1; also marked is the microstrip 4 which acts as a transmission line. This microstrip 4 is connected to a radiator part 5 that extends within and through the helix 2. With the patterning on the dielectric plate 1 it is possible to obtain other functions, as illustrated in the following favorable embodiments.

Figure 3A:
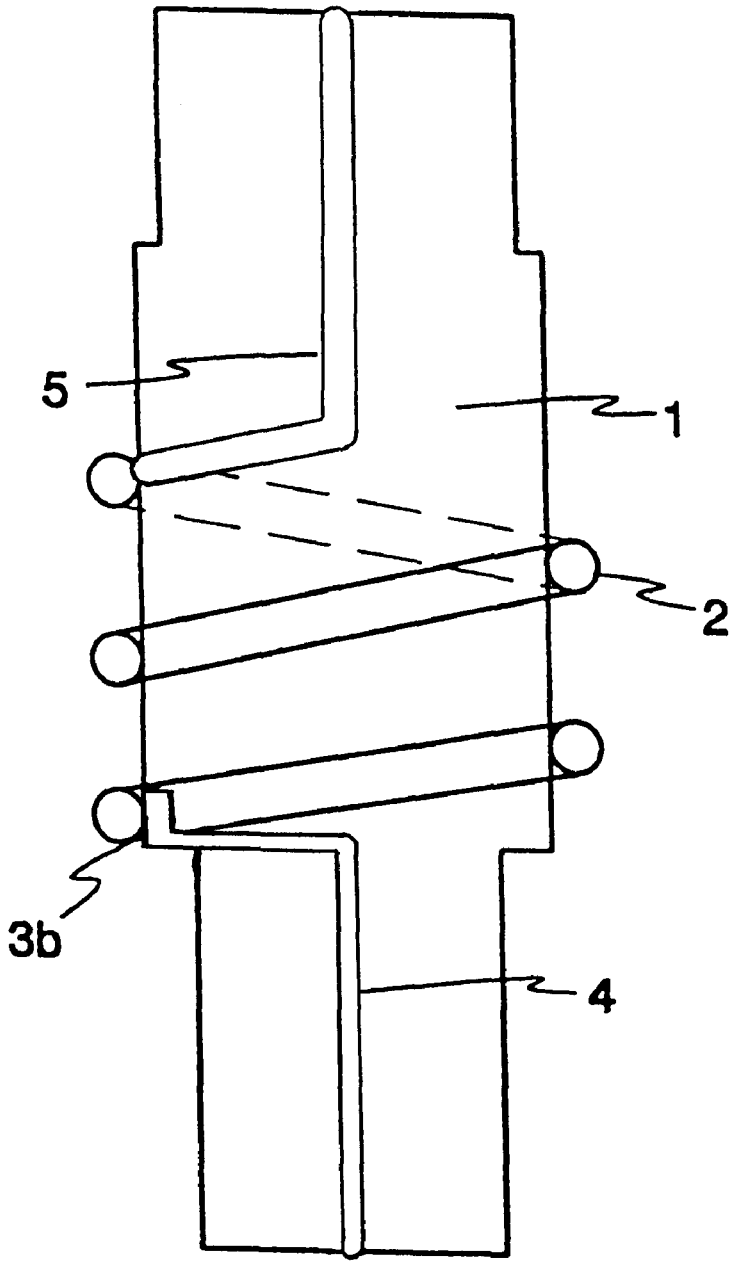
FIGS. 3(*a*) and 3(*b*) represent a modification of the basic structure with a shortened whip antenna on the helix.
Figure 3B:
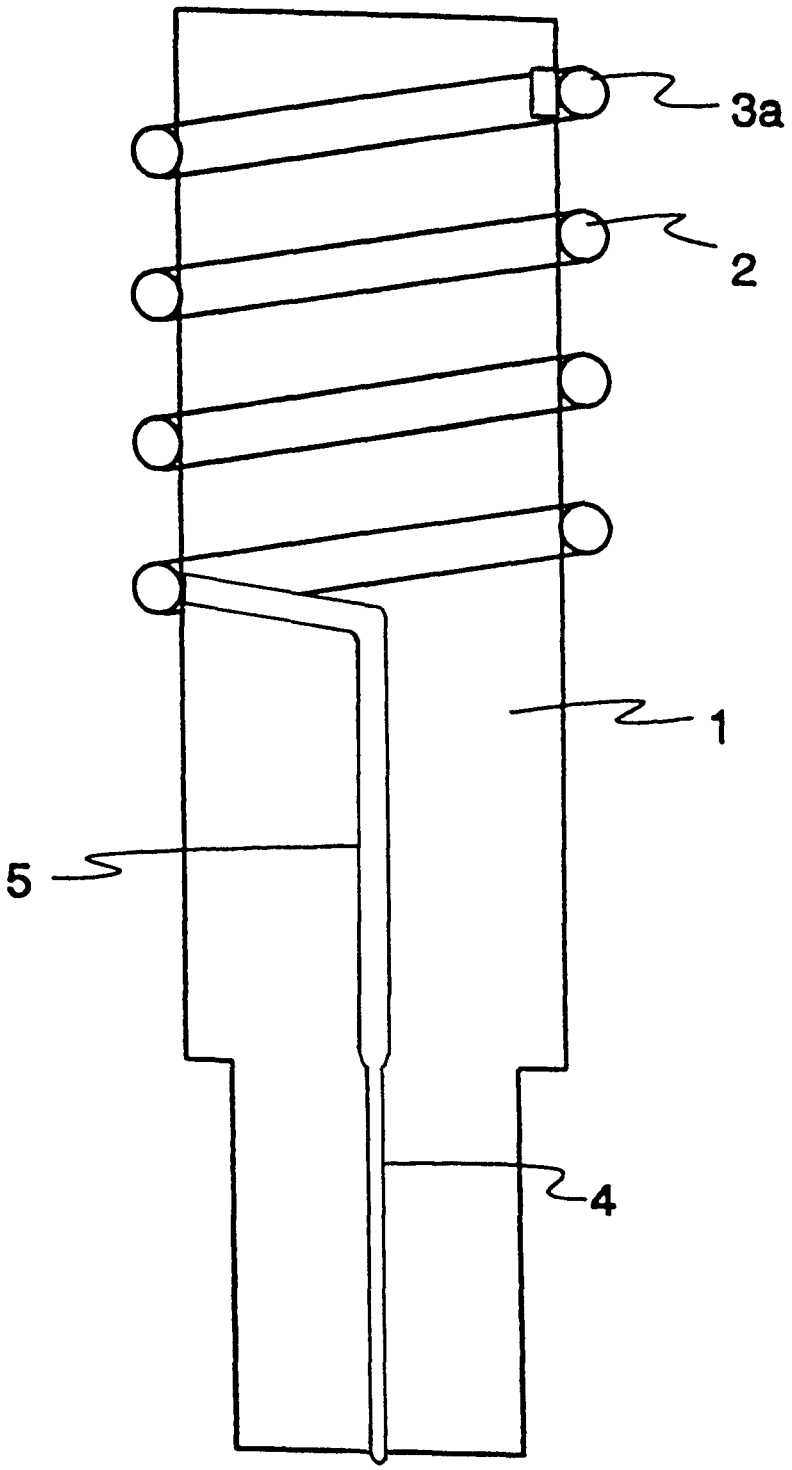

In FIGS. 3(*a*) and 3(*b*), a whip antenna shortened with a helix 2 is shown, where part of the pattern 5 of the dielectric plate 1 acts as the radiator 5 and not as a transmission line. The other part of the pattern still acts as the transmission line 4 and has attachment points 3*a* and 3*b*. Thus a combination is formed of (a) a helix antenna supported on the dielectric plate 1 and attached thereto, and (b) a whip antenna formed in the dielectric plate 1. The whip antenna may, as shown in the drawing, be either at the bottom or the top of the helix, but in such a way that it is attached to the lower part, or similarly to the upper part, of the helix.

Figure 4A:
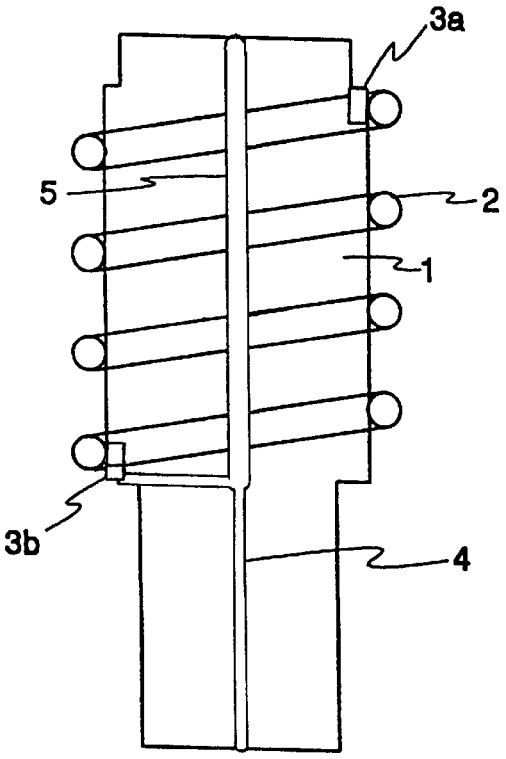
FIGS. 4(*a*) and 4(*b*) represent a modification where the helix forms an antenna operating at a certain frequency while the conducting pattern of the dielectric plate forms an antenna operating at another frequency.
Figure 4B:
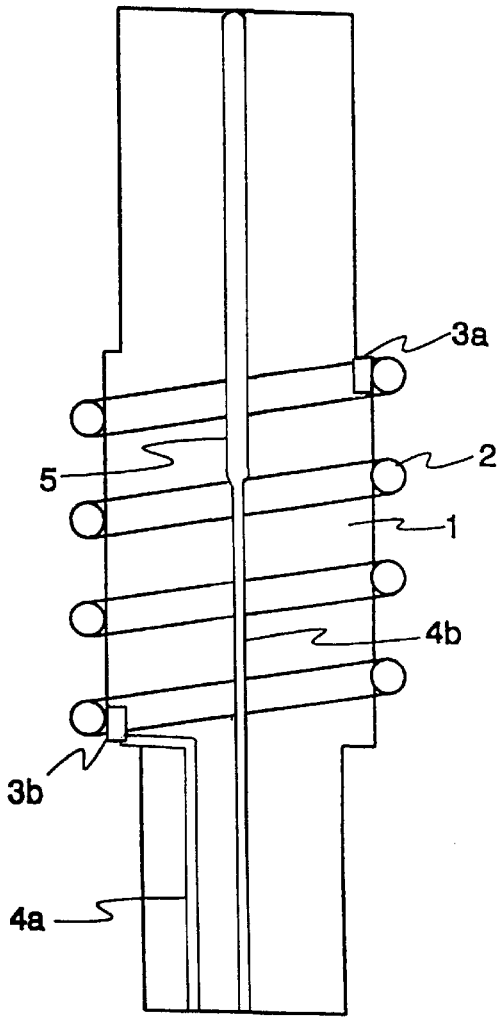

FIGS. 4(*a*) and 4(*b*) show an antenna tuned to two frequencies, which operation is achieved with a structure according to the invention, where the helix 2 is in tune at the lower frequency and the radiator or antenna 5 formed in the dielectric plate is in tune at the higher frequency. (Being in tune at a particular frequency means that the frequency in question is the antenna's resonance frequency. At this frequency the antenna operates more effectively than at other frequencies). The transmission line 4 may feed both the helix 2 and the whip antenna 5 (FIG. 4(*a*)), or separate feeds 4*a* and 4*b* may be provided for antennae 2 and 5 (FIG. 4(*b*)).

Figure 5A:
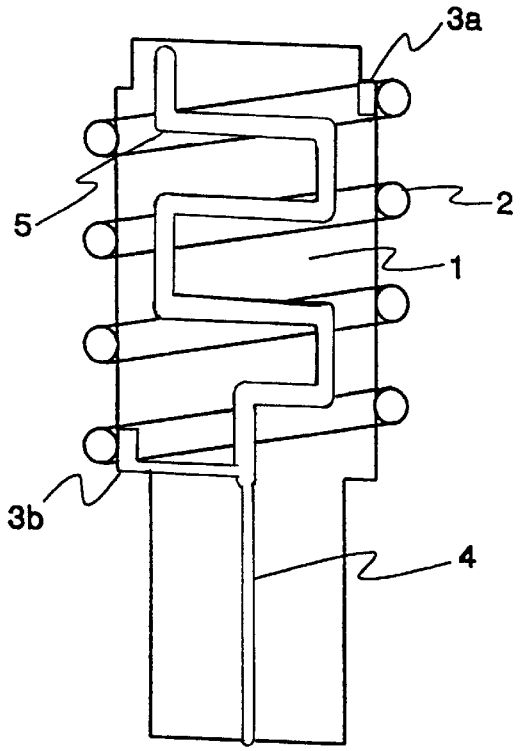
FIGS. 5(*a*) and 5(*b*) represent different ways of shortening the physical length of a whip antenna formed on the dielectric plate.
Figure 5B:
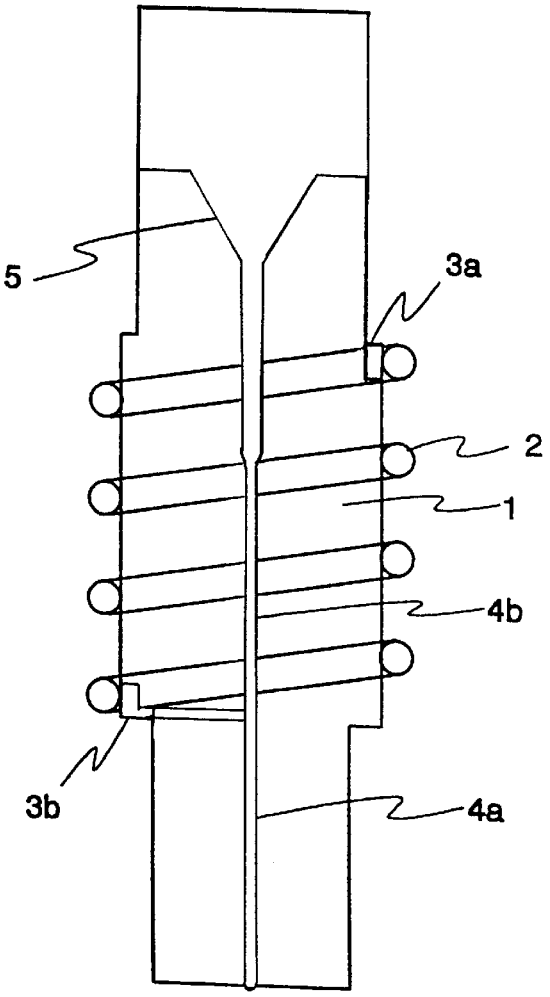

FIGS. 5(*a*) and 5(*b*) illustrate ways of physically shortening the length of the whip antenna 5 in the direction the longitudinal axis of the antenna, for example by a zigzag pattern (FIG. 5(*a*)) or by widening the conductor pattern at the top of the antenna (FIG. 5(*b*)). The above-mentioned methods are in themselves widely known methods for shortening a whip antenna, if one wishes to include two antennae operating at different frequencies within almost the same physical length. Also, in FIG. 5(*b*), the transmission line 4*a* of the helix 2 continues as transmission line 4*b* to the antenna 5 formed in the dielectric plate 1. The antennae according to FIGS. 5(*a*) and 5(*b*) may, for example, be realized by using different transmission lines in accordance with FIG. 4(*b*).

Figure 6A:
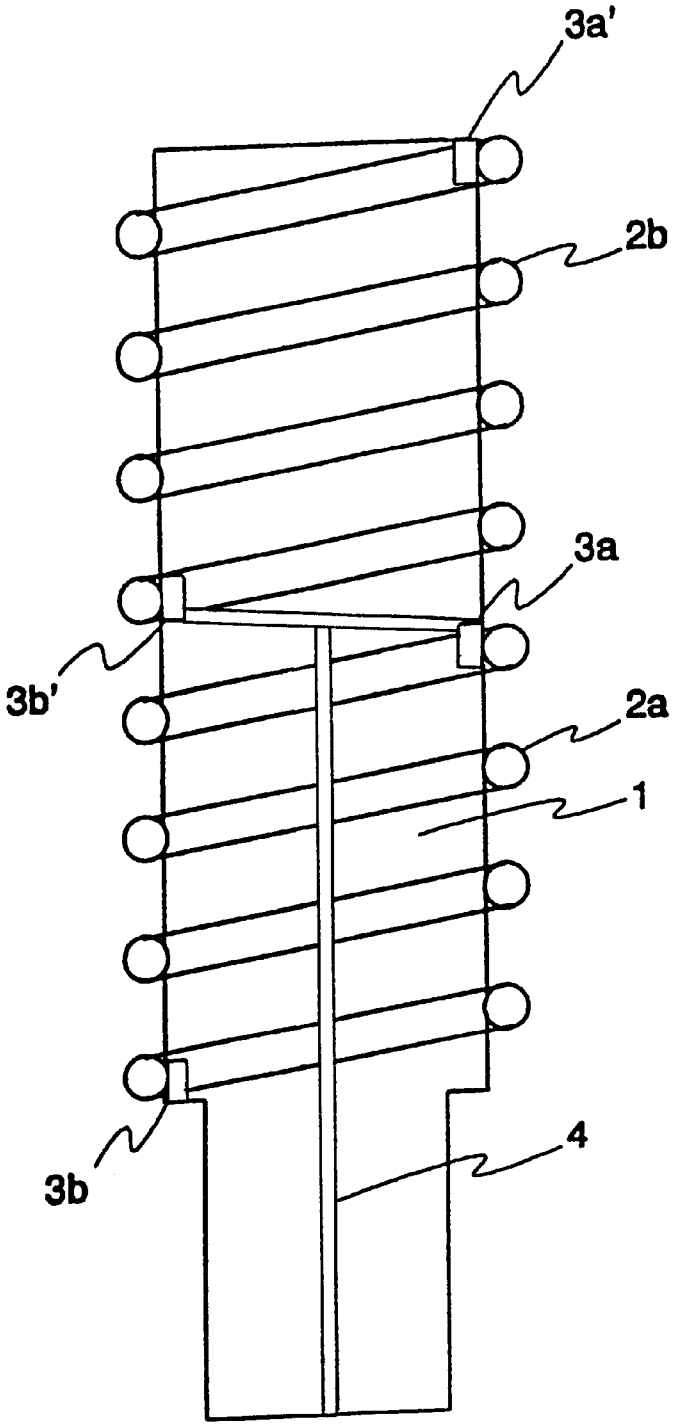
FIGS. 6(*a*)–6(*c*) represent different types of antenna produced with two helices.
Figure 6B:
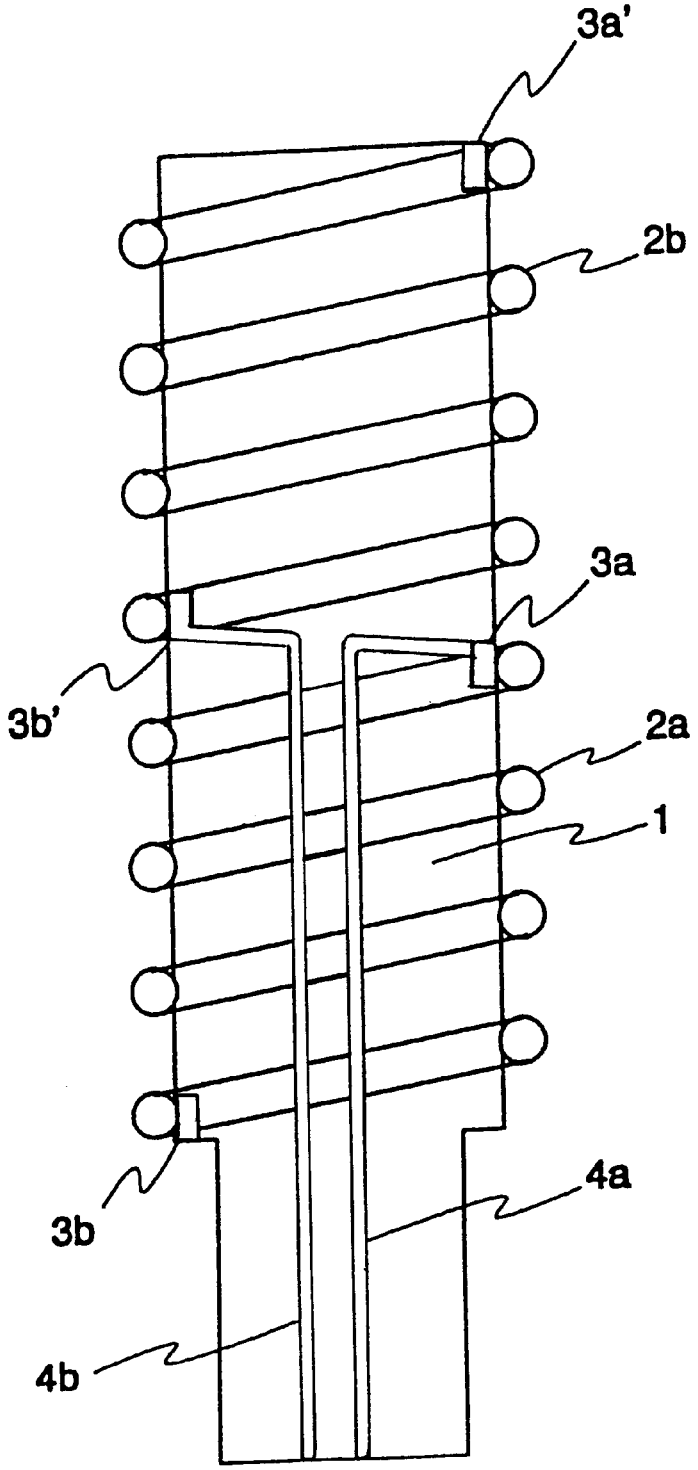
Figure 6C:
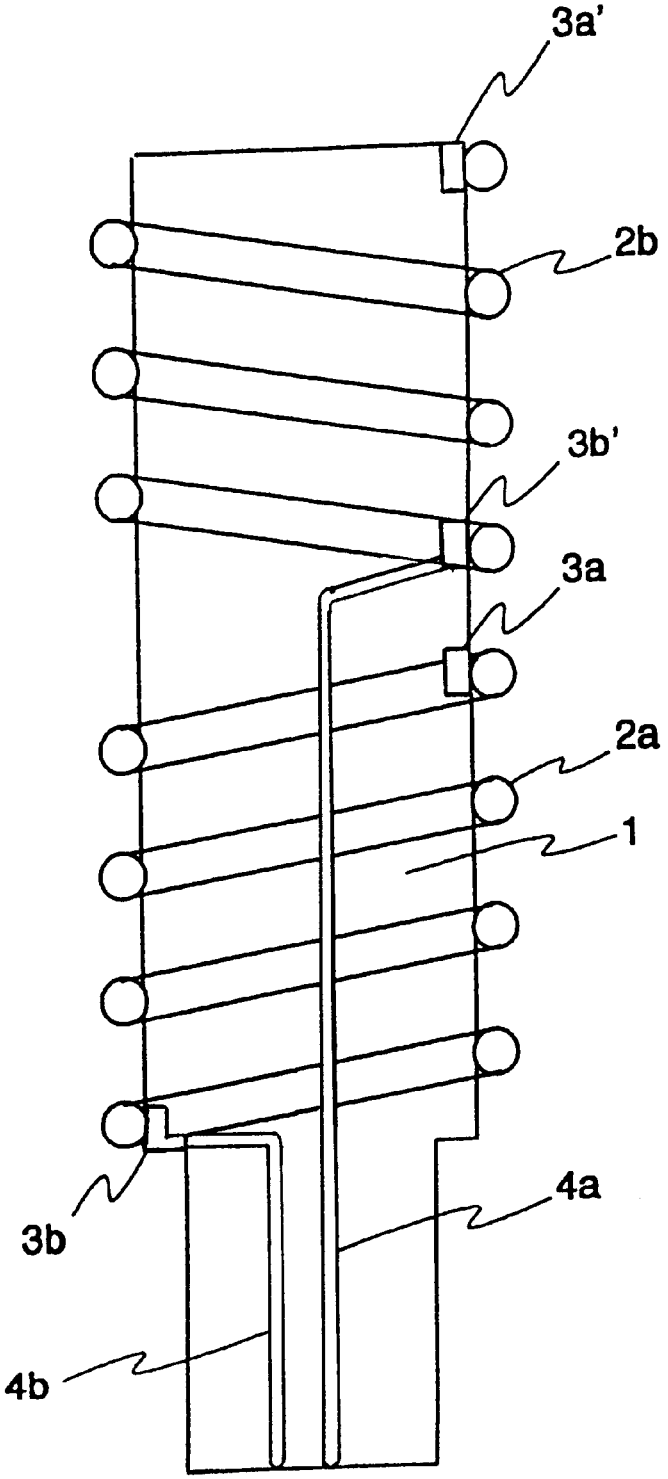

FIG. 6(*a*) shows a centrally fed helix-dipole antenna, which may be produced with the structure according to this invention. The antenna consists of two helices 2*a* and 2*b*, which are fed with a microstrip transmission line 4 from the center of the structure. Both helices may be attached to the dielectric plate 1 with their own attachment points 3*a*, 3*b* and 3*a*', 3*b*'. FIG. 6(*b*) shows the same structure, but with the helices 2*a* and 2*b* fed with a balanced transmission line 4 (4*a* and 4*b* of the same length). FIG. 6(*c*) shows a dual-band antenna, which consists of two helices 2*a* and 2*b* one on top of the other. Both are fed with different transmission lines 4*a* and 4*b*.

Figure 7A:
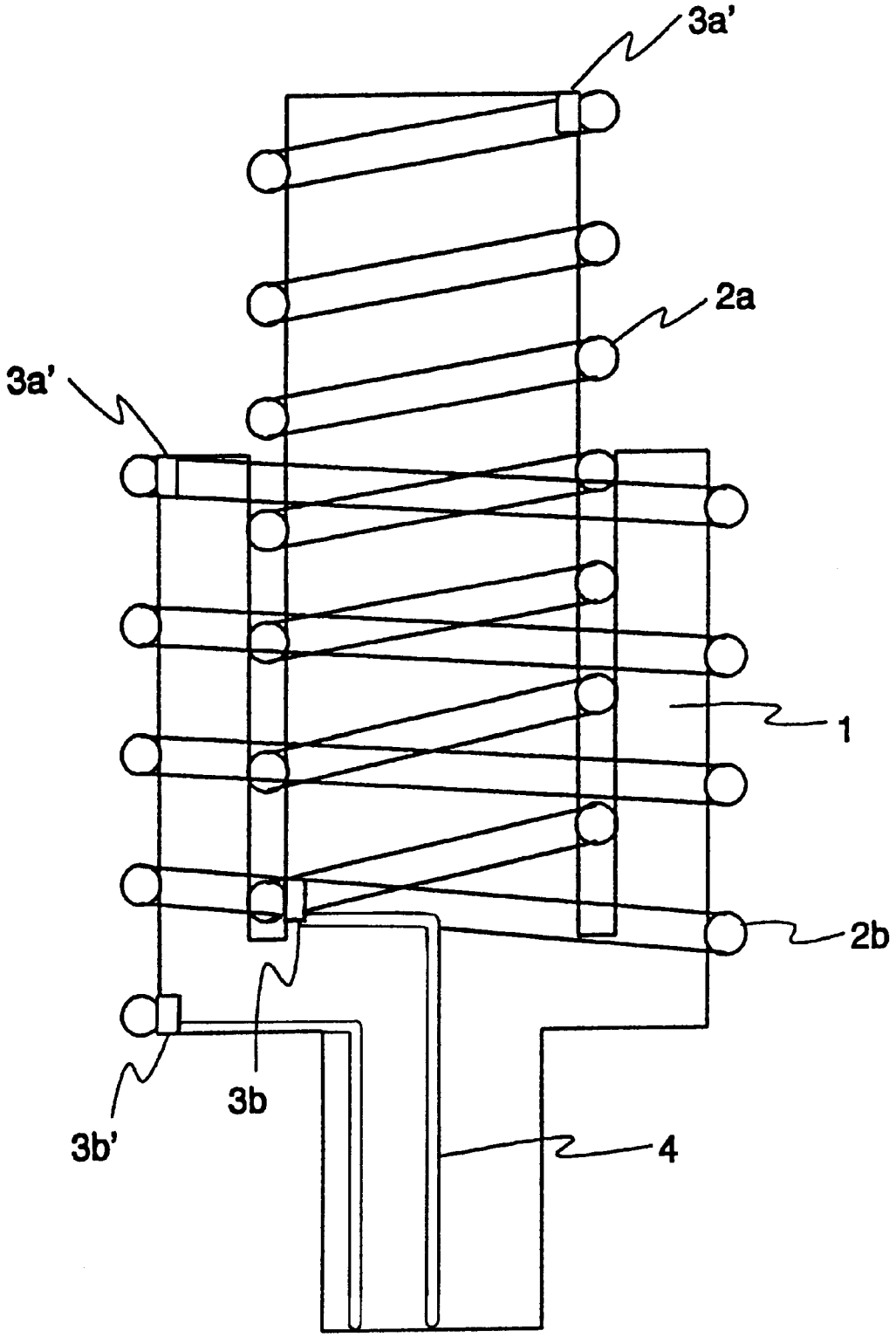
FIGS. 7(*a*) and 7(*b*) represent different antenna structures where the helices overlap.
Figure 7B:
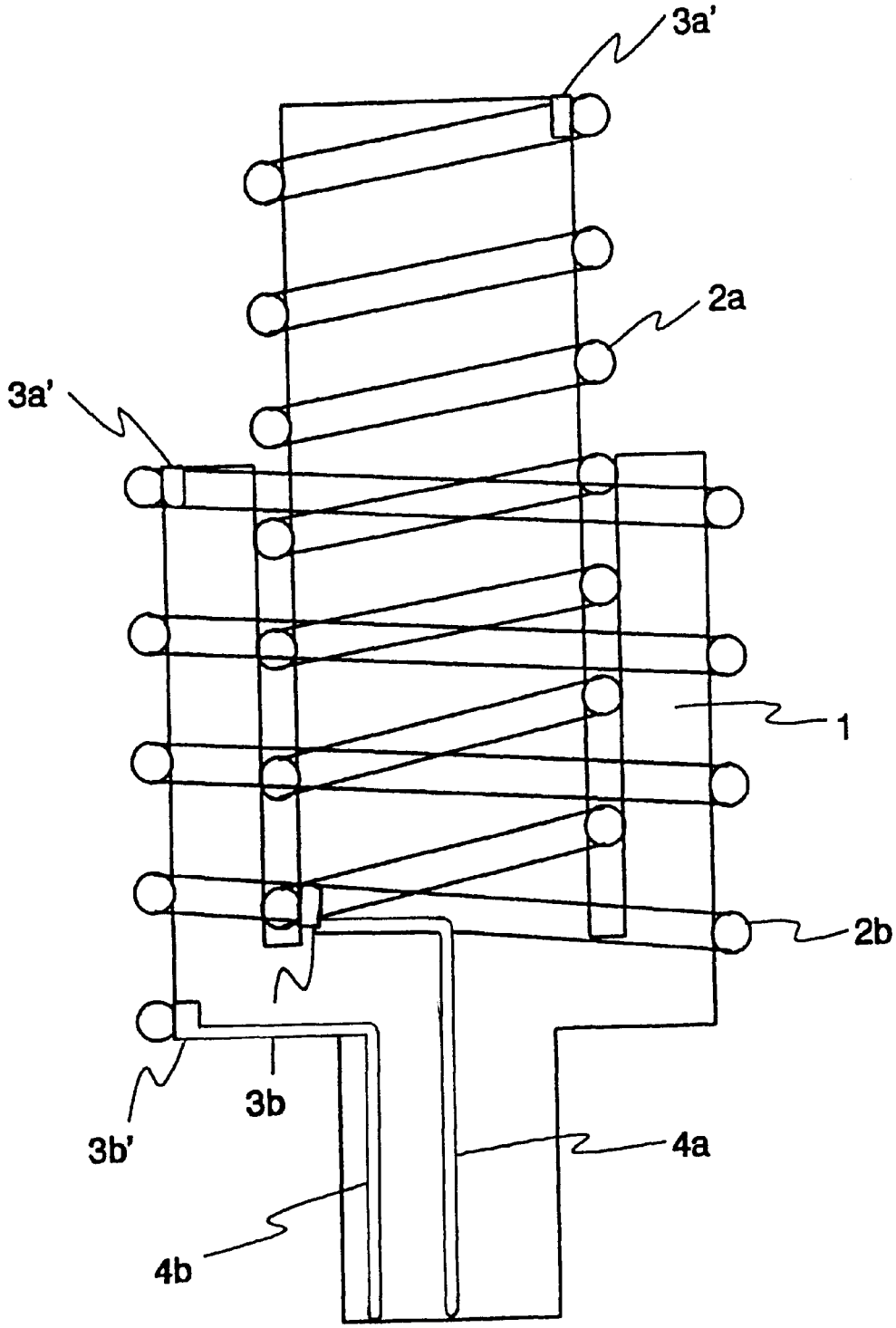

By shaping the dielectric plate 1 slightly differently, it is possible to produce structures with the solutions according to FIG. 7(*a*) and 7(*b*), in which the helices 2*a* and 2*b* are nested. The dielectric plate shown in these drawings comprises a support member for the helix antenna 2*b* of larger diameter and a support member for the helix antenna 2*a* of smaller diameter. The inner helix antenna 2*a* extends into the cavities made in the dielectric plate 1, so that the outer helix and the inner helix partly overlap. The inner helix 2*a* in FIG. 7(*a*) is fed with transmission line 4 and the helix 2*b* is a parasitic element, which increases the bandwidth of the antenna. FIG. 7(*b*) shows a similar nesting arrangement of the helices. With this structure it is possible to produce an antenna of two frequencies by feeding both helices 2*a* and 2*b* with their own transmission lines 4*a* and 4*b*.

The structures of FIGS. 7(*a*) and/or 7(*b*) may advantageously be combined with other embodiments described in this application, for example, with a radiator formed on the dielectric plate inside the helices.

Figure 8:
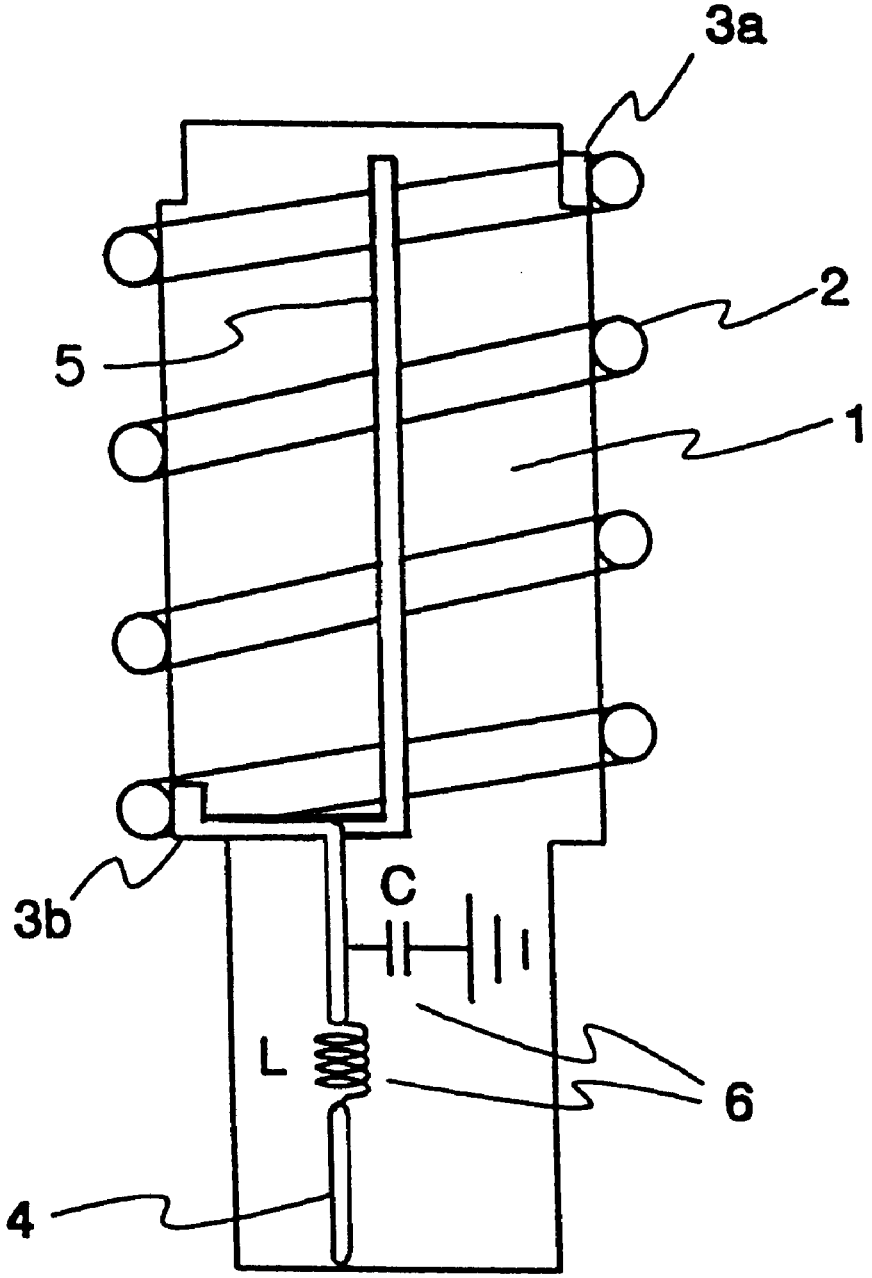
FIG. 8 shows an example where impedance matching devices are provided on the dielectric plate.

A further advantage of the structure according to this invention is the opportunity which it offers for having impedance matching devices in the antenna structure itself on the dielectric plate 1, as shown in FIG. 8. It is then possible to produce antennae of different electrical lengths and to adjust the impedance to that required, where it can be done with the least loss, or as close as possible to the feed point. The impedance elements 6 may be inductances or capacitances, created for example by strip line technology, or separate components.

Figure 9A:
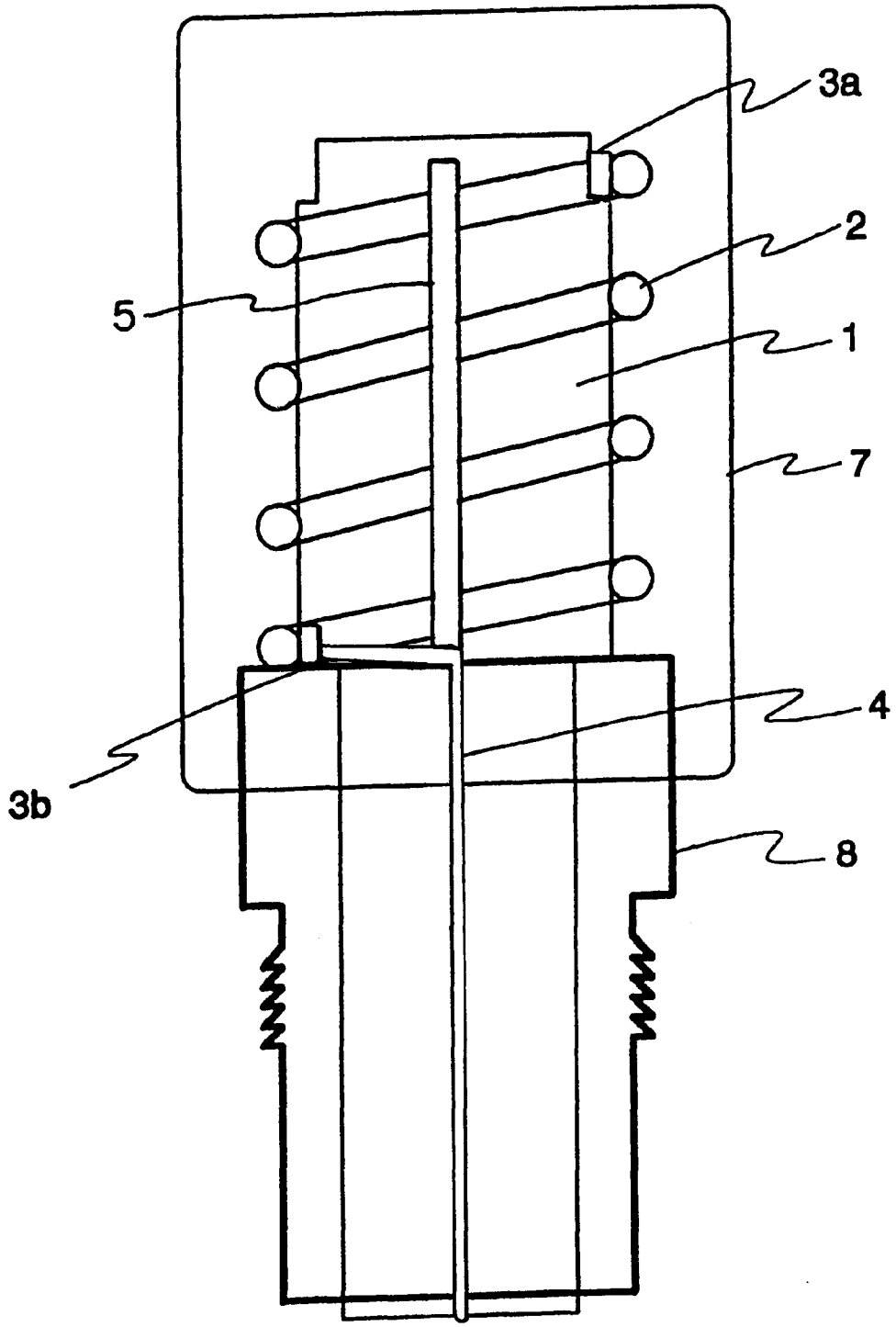
FIGS. 9(*a*) and 9(*b*) illustrate various possibilities for attachment of the antenna structure to a connector.
Figure 9B:
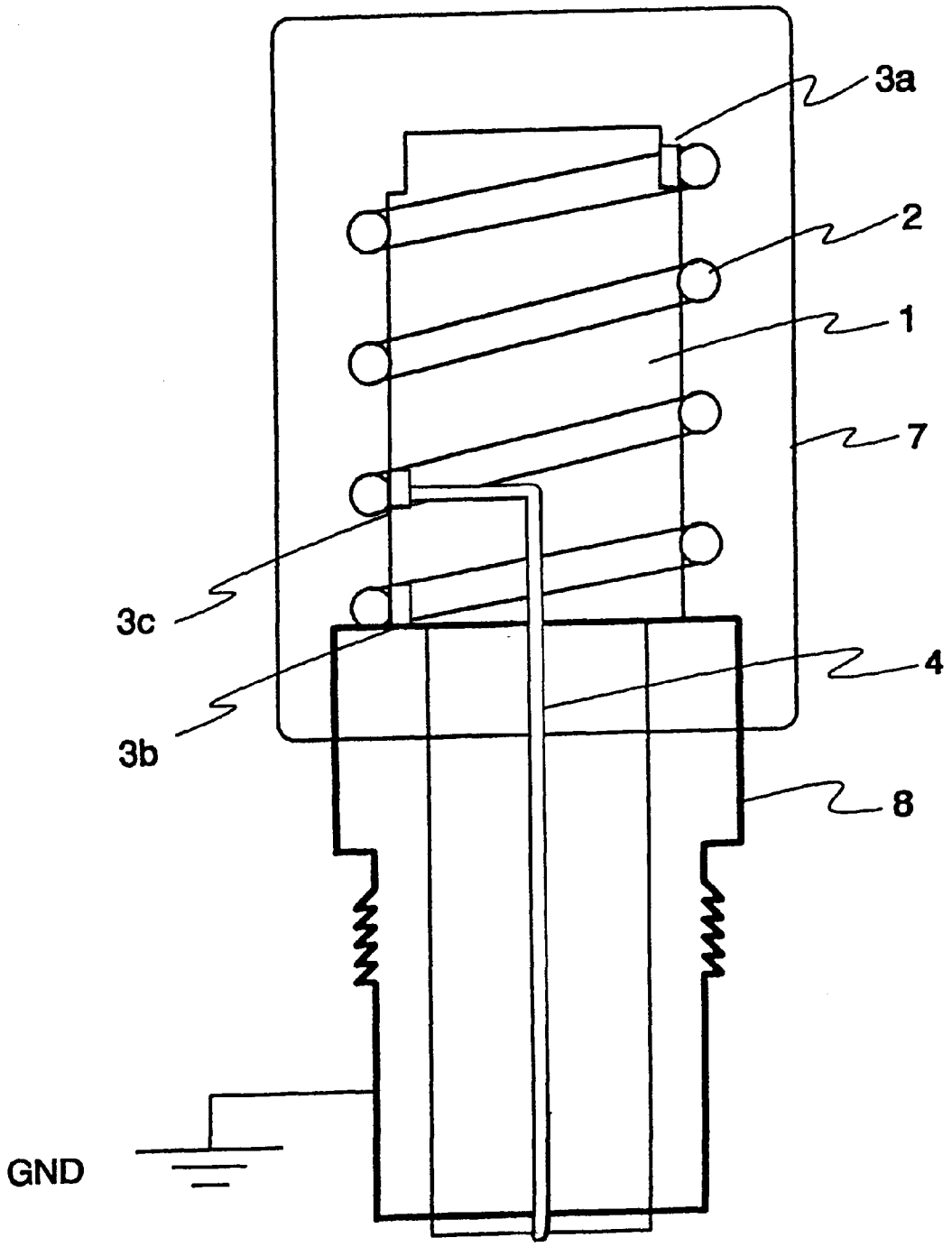

The structure according to the invention may be made to advantage as part of a radio device's own circuit board, or it may be attached thereto for example by soldering or by a circuit board connector. FIGS. 9(*a*) and 9(*b*) show a favorable way of attaching a structure according to the invention to a separate connector 8. In that case, the dielectric plate 1 extends through the aperture in the connector 8. In order to improve the mechanical strength, the antenna may be attached for example by die casting into the protective casing 7. A high-frequency signal may be fed either directly to the lower end of the helix, as in FIG. 9(*a*), or the connection may be made coaxial, as in FIG. 9(*b*). The conductor 4 then acts as the inner wire of the coaxial conductor. Transmission may be effected, for example, by pegging to a point of the impedance suitable for the helix.

The present invention is not restricted to a particular application but may be used in antennae in different applications and at different frequencies, preferably at UHF and VHF radio frequencies. The structures presented above are by way of example. In different embodiments of the same invention the dielectric plate may be of different forms. Also, the number of helices, the transmission method employed in the antenna structure and the adapting devices effected may vary according to the antenna structure. The structure may be used to advantage in mobile telephone antennae, among other things.

We claim:

1. An antenna for a communication device operating at radio frequency, which antenna comprises:

a cylindrical coil conductor which forms a helix, the coil being fed a high frequency signal; and a generally planar dielectric plate mechanically supporting said helix, said helix being attached to said dielectric plate by at least one attachment point, said dielectric plate having a radiator which supports an electrically conductive conductor pattern thereon which is in electrical contact with said helix and extends, at least in part, inside said helix.

2. An antenna in accordance with claim 1, characterized in that the conductor pattern forms a transmission line for feeding the antenna.

3. An antenna in accordance with claim 1, characterized in that the radiator is a whip antenna.

4. An antenna in accordance with claim 1, characterized in that the helix has a particular first operating frequency and that the radiator formed by the conductor pattern has a particular second operating frequency, which is a different frequency from the said first operating frequency.

5. An antenna in accordance with claims 1, characterized in that it additionally comprises a connector for its attachment to a radio appliance or to a component thereof.

6. An antenna in accordance with claim 2, characterized in that it comprises a second cylindrical coil conductor which forms a second helix.

7. An antenna in accordance with claim 6, characterized in that in the antenna there are two transmission lines, the first of which is in contact with the first helix and the second of which is in contact with the second helix.

8. An antenna in accordance with claim 6, characterized in that the said first and second helices are at least partially one within the other.

9. An antenna in accordance with claim 6, characterized in that the first helix has a particular first operating frequency and the second helix has a particular second operating frequency, which is a different frequency from the said first operating frequency.

10. An antenna in accordance with claim 1, characterized in that in the transmission line there are impedance matching devices.

11. An antenna for a communication device operating at radio frequency, which antenna comprises:

a first cylindrical coil conductor connecting with a transmission line said first cylindrical coil conductor forming a first helix and being fed a high frequency signal; and a generally planar dielectric plate mechanically supporting said first helix, said first helix being attached to said dielectric plate by at least one attachment point, said dielectric plate having an electrically conductive conductor pattern thereon which is in electrical contact with said first helix and extends, at least in part, inside said helix and said conductor pattern forming a transmission line for feeding said antenna; and a second cylindrical coil which forms a second helix, said second helix being a parasitic element for increasing the bandwidth of said antenna.

* * * * *